US008109106B2

(12) United States Patent
Kang

(10) Patent No.: US 8,109,106 B2
(45) Date of Patent: Feb. 7, 2012

(54) MALFUNCTION PREVENTING DEVICE FOR REFRIGERATOR AND METHOD THEREOF

(75) Inventor: Dae Jong Kang, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 351 days.

(21) Appl. No.: 11/752,179

(22) Filed: May 22, 2007

(65) Prior Publication Data

US 2007/0276543 A1 Nov. 29, 2007

(30) Foreign Application Priority Data

May 22, 2006 (KR) ..... 10-2006-0045843

(51) Int. Cl.
*G05D 23/32* (2006.01)

(52) U.S. Cl. ..... 62/158; 62/126; 62/127; 62/157; 62/231

(58) Field of Classification Search ..... 200/600; 340/407.1, 407.2; 323/304; 62/126, 127, 62/157, 158, 231; 236/46 C, 94
See application file for complete search history.

(56) References Cited

U.S. PATENT DOCUMENTS 6,781,574 B1 * 8/2004 Kim ..... 345/168
6,834,162 B1 * 12/2004 Schnell ..... 396/153
2002/0038553 A1 * 4/2002 Yun et al. ..... 62/126
2005/0056046 A1 3/2005 Lee
2005/0066238 A1 * 3/2005 Park ..... 714/43
2007/0273673 A1 * 11/2007 Park et al. ..... 345/179

FOREIGN PATENT DOCUMENTS

JP 58085637 A * 5/1983
KR 1999-0014674 U 5/1999
KR 1999-0027937 U 7/1999
KR 10-2004-0073879 A 8/2004
KR 10-2005-0028190 A 3/2005

OTHER PUBLICATIONS

JP 58085637 A (Patent Abstract).*

* cited by examiner

*Primary Examiner* — Cheryl J Tyler
*Assistant Examiner* — Paolo Gonzalez
(74) *Attorney, Agent, or Firm* — Birch, Stewart, Kolasch & Birch, LLP

(57) ABSTRACT

The present invention relates to a malfunction preventing device and a method thereof, which ignores an input signal produced by electricity capacity variation because of moisture to prevent a malfunction of a refrigerator. A malfunction preventing device for a refrigerator includes an inputting part in which a static electricity switch is provided to produce an input signal, and a controlling part that ignores a first input signal inputted in a wait mode, wherein there is no inputted signal from the inputting part for a predetermined delaying time period in the wait mode. A method for preventing a malfunction of a refrigerator includes performing a wait mode in that there is no input signal produced by static electricity for a predetermined delay time period, and ignoring a first input signal inputted in the wait mode.

5 Claims, 6 Drawing Sheets

MALFUNCTION PREVENTING DEVICE FOR REFRIGERATOR AND METHOD THEREOF

CROSS REFERENCE TO RELATED APPLICATION

The present disclosure relates to subject matter in priority of Korean Patent Application No. 10-2006-0045843, filed on May 22, 2006, which is hereby incorporated by reference as if fully set forth herein.

BACKGROUND OF THE DISCLOSURE

1. Field of the Disclosure

The present invention relates to a refrigerator. More particularly, the present invention relates to a malfunction preventing device and a method thereof, which ignores an input signal produced by electricity capacity variation because of moisture to prevent a malfunction of a refrigerator.

2 . Discussion of the Related Art

Refrigerators typically have plural storage compartments in which food items are stored and a predetermined side of the storage compartment is opened to allow a user to put in or take out the food items through.

A door is coupled to the opened side to open and close the storage compartment.

In addition, a control device is provided in the refrigerator and a user may control temperature, humidity and lightning of the storage compartments by using the control device. The control device may be commonly provided on a front surface of the door coupled to the storage compartment, such that a user can control the control device without difficulties.

Recently, exterior material such as glass or resin has been attached to the front surface of the refrigerator door to enhance an overall exterior beauty.

As shown in FIGS. 4 to 6, an assembly process of the conventional refrigerator will be explained. A control device 30 is mounted inside an exterior material attached on a front surface of a door 20 coupled to the conventional refrigerator 10. Buttons 90 of the control device 30 and a displaying part are typically exposed outside.

The control device 30 is commonly formed in a plate shape and the display part is mounted on a front surface of the control device 30 to display operational conditions of the refrigerator 10 and control information selected by a user. Also, plural buttons 90 are provided on the control device 30 and a user pushes the buttons 90 to control the control device 30.

The exterior material 40 is attached on the front surface of the door 20 to enhance an overall exterior beauty of the refrigerator 10 and it is formed in a plate shape that is identical to the shape of the door 20. Recently, it has been developed that a glass plate or a resin plate is attached on a front surface of the door 20.

As a result, the control device 30 is attached to a rear surface of the exterior material 40 and the display part as well as the buttons 90 provided on the front surface of the controlling part 30 may be exposed outside.

As shown in FIGS. 5 and 6, to expose the display part and the buttons 90 outside, an opening 41 is formed at a predetermined portion of the exterior material 40 and the front surface of the control device 30 is exposed through the opening 41 when the control device 30 is attached to an inner circumferential surface of the opening 41.

At this time, an outer front surface portion of the control device 30 is attached to the inner circumferential surface of the opening 41 and a fixing member such as a screw and variation of it fixes the control device 30 to the rear surface of the exterior material 40. Thus, the display part and the buttons 90 of the control device 30 are exposed outside through the opening 41 of the exterior material 40.

As a result, when he/she tries to control the refrigerator 10, a user uses the display part and the buttons 90 exposed through the opening 41 of the exterior material 40.

In addition, there have been developed a static electricity switch that can sense a minute static electricity produced at a user's body without a user's direct contact and a control device that is operated by the static electricity switch.

However, if the above static electricity switch is used, an electric capacity near the static electricity switch might be variable because of external moisture. As a result, even when a user does not input a predetermined command, a controlling operation may be performed regardless of the user's intention, which might be a problem.

SUMMARY OF THE DISCLOSURE

Accordingly, the present invention is directed to a refrigerant valve control device and a control method thereof.

The present invention is to provide a malfunction preventing device and a method thereof, which ignore an input signal produced by electricity capacity variation because of moisture.

In another aspect, the present invention is to provide a malfunction preventing device and a method thereof, which ignores a first input signal in a wait mode and cancels the wait mode before displaying and notifying a user the cancellation to prevent a malfunction.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these advantages and in accordance with the purpose of the invention, as embodied and broadly described herein, a malfunction preventing device for a refrigerator includes an inputting part in which a static electricity switch is provided to produce an input signal and a controlling part that ignores a first input signal inputted in a wait mode. There is no inputted signal from the inputting part for a predetermined delaying time period in the wait mode.

The controlling part cancels the wait mode, if the controlling part receives the first input signal.

Here, the first input signal is an input signal that the controlling part receives first in the wait mode.

The controlling part processes a second input signal that the controlling part receives after the first input signal if the wait mode is canceled.

The second input signal may be an input signal that the controlling part receives within a predetermined delay time period when the first input signal is inputted.

It is preferred that the controlling part re-starts the wait mode if there is no input signal in a predetermined delay time period after the wait mode is canceled.

The controlling part starts an input mode that performs control based on a user's input, it the first input signal received.

The controlling part may re-start the wait mode, if there is no input signal in a predetermined delay time period after the input mode starts.

The malfunction preventing device for a refrigerator may further include a displaying part that displays cancellation of the wait mode.

In another aspect, a method for preventing a malfunction of a refrigerator includes: performing a wait mode in that there is no input signal produced by static electricity for a predetermined delay time period; and ignoring a first input signal inputted in the wait mode.

After ignoring a first input signal inputted in the wait mode, the method may further include canceling the wait mode.

After canceling the wait mode, the method may further include re-starting the wait mode, if there is no input signal for a predetermined delay time period.

Here, the first input signal is an input signal that the controlling part receives first in the wait mode.

After ignoring a first input signal inputted in the wait mode, the method may further include processing a second input signal inputted within a predetermined delay time period.

After ignoring a first input signal inputted in the wait mode, the method may further include starting an input mode that performs control based on a user's input.

After starting an input mode that performs control based on a user's input, the method may further include re-starting the wait mode, if there is no input signal for a predetermined delay time period.

After ignoring a first input signal, the method may further include displaying cancellation of the wait mode.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure.

In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
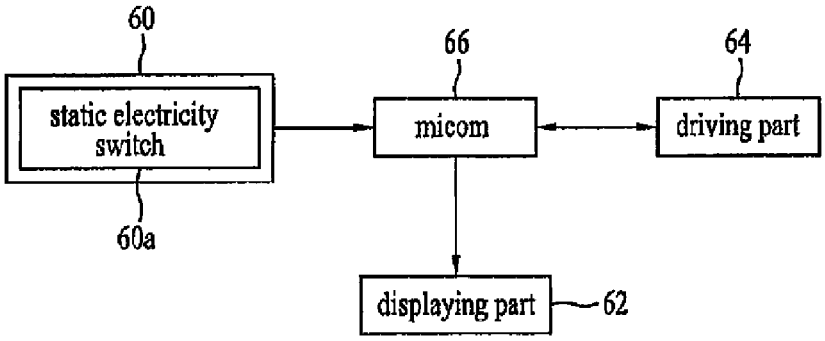
FIG. 1 is a diagram illustrating a malfunction preventing device for a refrigerator according to the present invention.

FIG. 1 is a diagram illustrating a malfunction preventing device for a refrigerator according to the present invention.

As shown in FIG. 1, the malfunction preventing device includes an inputting part 60, a displaying part 62, a driving part 64 and a controlling part 66. A user inputs a command by using the inputting part 60. The displaying part 62 displays refrigerator information to the user. The driving part 64 operates a freezing cycle to compress refrigerant and flow cool air. The controlling part 66, which may be a micom, controls the freezing cycle based on a predetermined algorism and performs control based on the user's input.

The inputting part 60 includes a static electricity switch 60*a* and the static electricity switch 60*a* can sense a minute static electricity that is produced from the user's body. The user approaches the static electricity switch 60 to perform predetermined inputting (for example, setting the temperature inside a refrigerator and freezer compartment, changing a kind of dispenser service and data inputting).

The displaying part 62 displays refrigerator information to the user (for example, the present temperature inside the refrigerator and freezer compartment, a predetermined temperature, a kind of a dispenser service, weather information and pictures). Especially, the displaying part 62 may display a user interface that allows the user to input through the inputting part 60 smoothly.

The driving part 64 directly operates a compressor (not shown), a refrigerant valve (not shown), a damper (not shown) and a lighting (not shown) that are provided in the refrigerator based on the control of the controlling part 66.

The controlling part 66 may control the driving part 64 and the displaying part 62 based on the predetermined algorism, or the controlling part 66 may control the displaying part 62 and the driving part 64 based on the user's inputting through the inputting part 60. The controlling part 66 performs an input mode in that the user's inputting is performed immediately and a wait mode in that inputting is waited if there is no input signal for a predetermined time period.

In the wait mode, it is preferred that the displaying part 62 displays the wait mode and thus the user may be notified that he/she can input a command immediately in the present mode.

Electric capacity may be varied by moisture and thus an input signal might be produced because of the variation of electric capacity. Although the input signal produced because of the electric capacity variation is inputted through the inputting part 60 in the wait mode, the controlling part 66 controls the predetermined control based on the input signal not to be perform, which prevents a malfunction. This process will be shown in FIG. 3.

Figure 2:
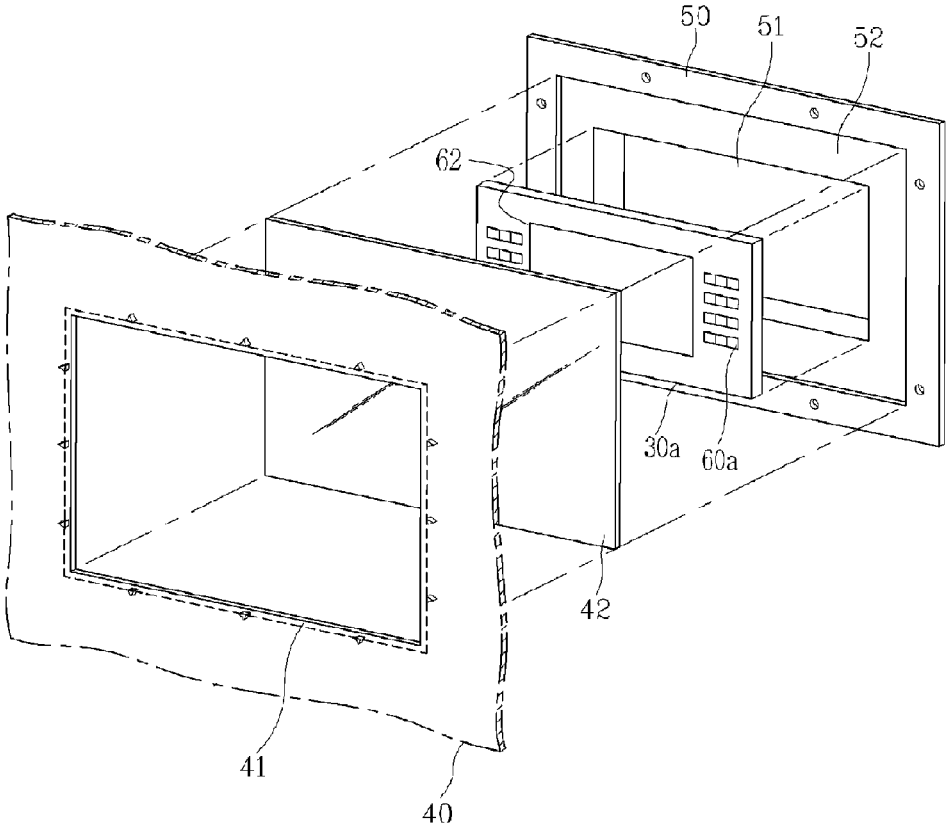
FIG. 2 is an exploded perspective view illustrating a control device including the malfunction preventing device shown in FIG. 1.

FIG. 2 is an exploded perspective view illustrating a control device in which the malfunction preventing device is provided for a refrigerator according to the present invention.

A static electricity switch 60*a* is attached to the control device 30*a* in which the malfunction preventing device shown in FIG. 2 is provided. The control device 30*a* is held within a housing 50 and thus it is fixed to a rear surface of the exterior material 40 of the door 10. Together with that, an exterior plate 42 is additionally provided on a front surface of the exterior material 40.

The exterior material 40 is formed in a plate shape to enhance an overall exterior beauty of the door 20 and the exterior material 40 may be a glass plate that has a high glossy characteristic. The controlling part 30*a* may be installed in the rear of the exterior material 40.

The control device 30*a* includes the controlling part 66 connected to the power and other parts of the refrigerator 10 to control temperature, humidity and lightning of the storage compartments, which may be a micom. The control device 30*a* is formed in a square plate shape and it is provided between the exterior material 40 and the outer door.

The static electricity switch 60*a* is mounted in the control device 30*a* to sense a minute static electricity that flows in a user's body. When a human body approaches to the static electricity switch 60*a* and the control device 30*a* in a predetermined distance, the controlling part 66 may control the refrigerator.

An opening 41 is formed at a predetermined portion of the exterior material 40 where the control device 30*a* is provided and the displaying part 62 of the control device 30*a* is exposed outside through the opening 41. Here, the opening 41 has the same appearance as the front surface of the control device 30*a* (or the displaying part 62).

The control device 30*a* is fixed to a rear surface of the opening 41, being held within a housing 50.

The housing 50 has a box shape that forms inner space and the control device 30*a* is held in the space. Also, a side of the box shaped housing 50 facing the exterior material 40 is opened.

The housing 50 includes a control device groove 51 and an exterior plate groove 52.

The control device groove 51 is recessed inward at a center of the housing 50 along the shape of the control device 30*a* and the control device 30*a* is held in the control device groove 51.

The exterior plate groove 52 is recessed and stepped inward at a predetermined portion of the housing 50 along a rim of the control device groove 51 and an exterior plate 42, which will be described later, is held in the exterior plate groove 52.

The exterior plate 42 is attached to the front surface of the control device 30*a*.

The exterior plate 42 is formed in a plate shape that corresponds to the exterior material 40 and it is fabricated with the same material as the exterior material 40. This embodiment presents that the exterior plate 42 is fabricated with transparent glass. As a result, the front surface of the displaying part 62 may be transparent through the glass exterior plate 42 and the exterior plate 42 covers the front surface of the control device 30*a*.

The exterior plate 42 is formed in a plate shape that corresponds to the shape of the front surface of the control device 30*a*. The exterior plate 42 may be a little larger than the opening 41 and thus the exterior plate 42 may be fixed along an outer rim of the rear surface of the opening 41.

Figure 3:
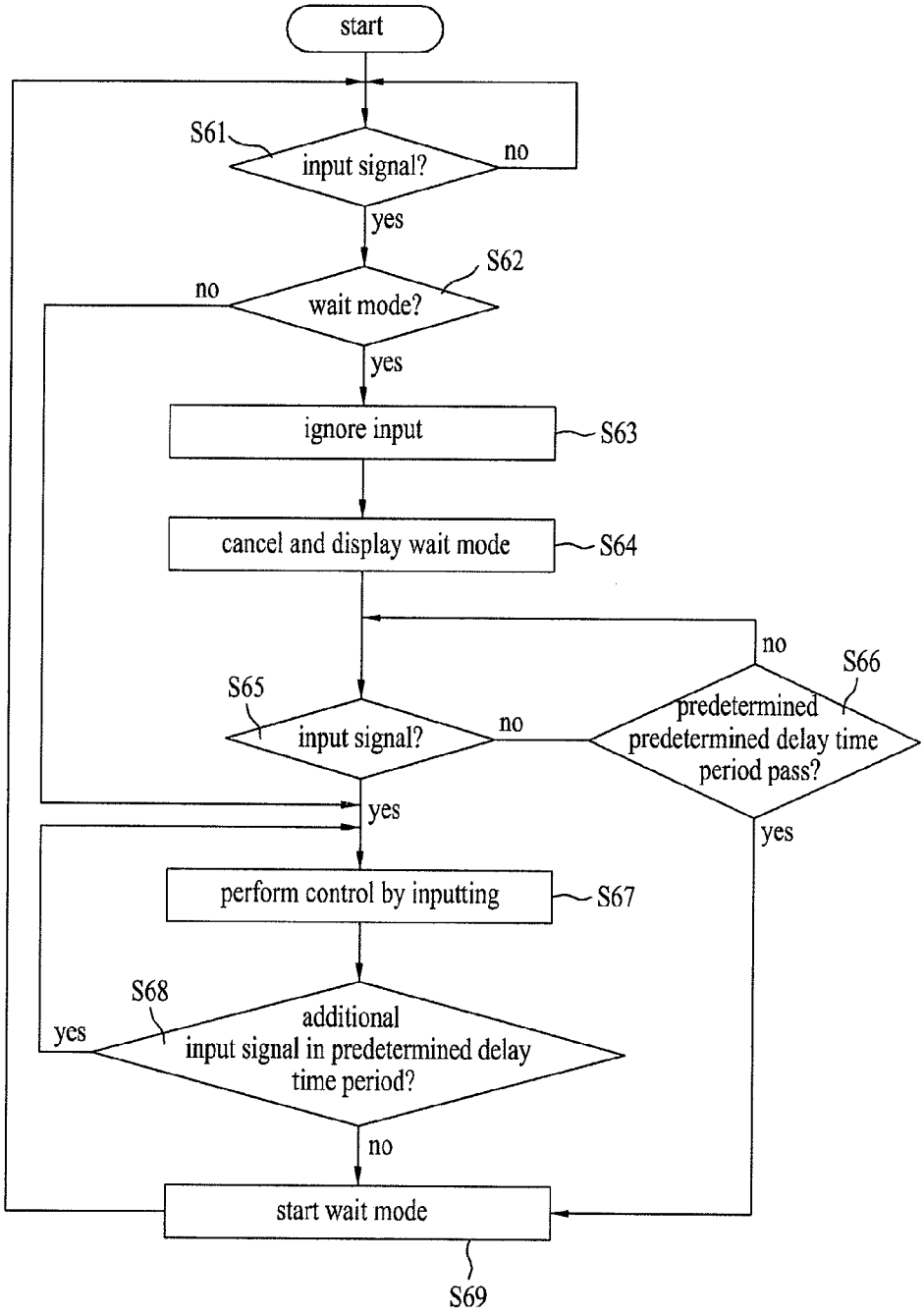
FIG. 3 is a flow chart illustrating a method for preventing a malfunction of a refrigerator according to the present invention.
Figure 4:
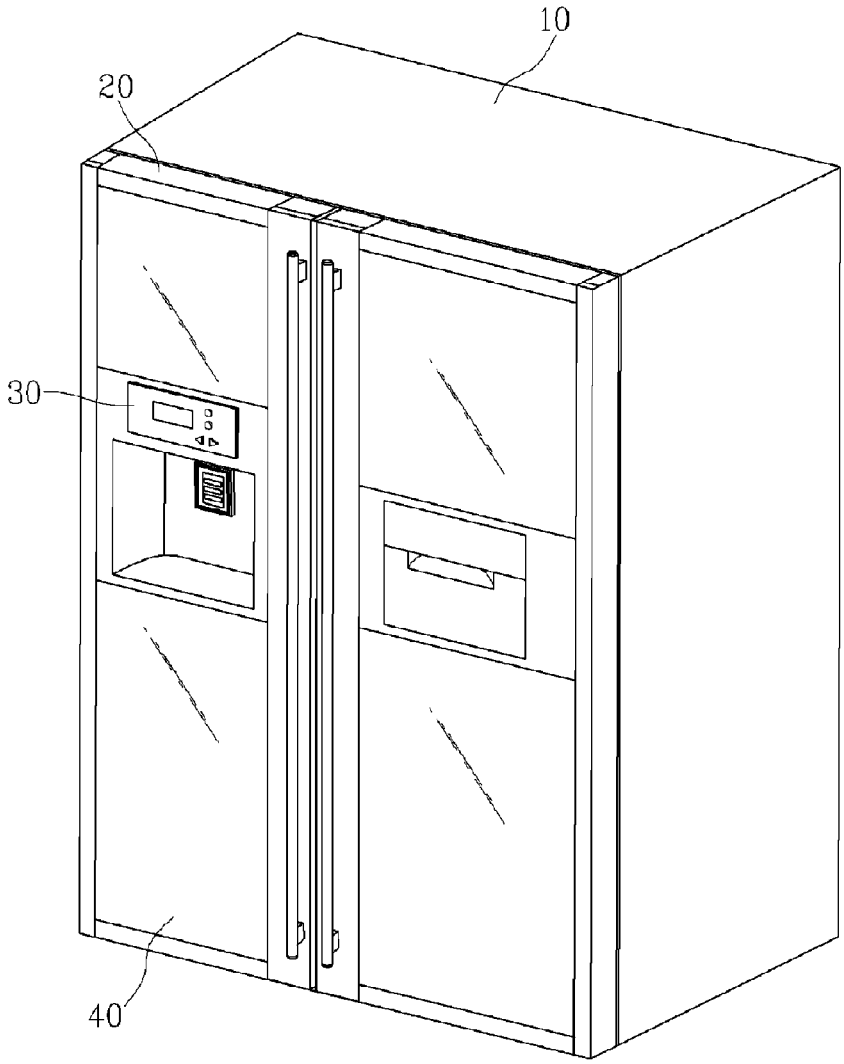
FIG. 4 Conventional Art
FIG. 4 is a perspective view illustrating a conventional refrigerator.
Figure 5:
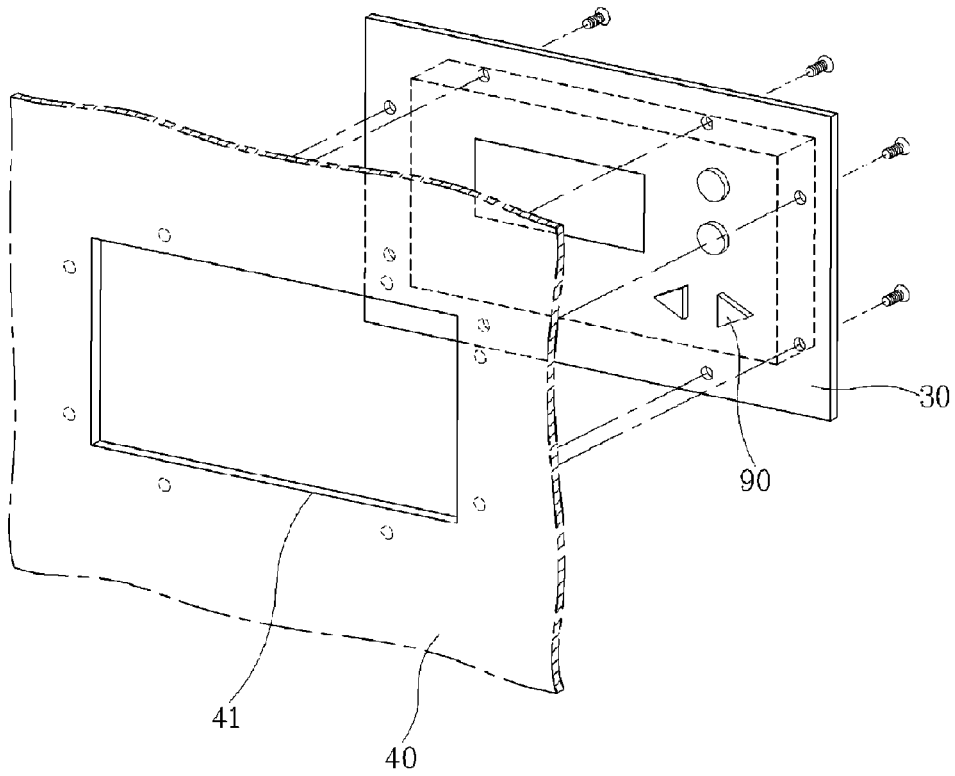
FIG. 5 Conventional Art
FIG. 5 is a perspective view illustrating the control device provided in the conventional refrigerator.
Figure 6:
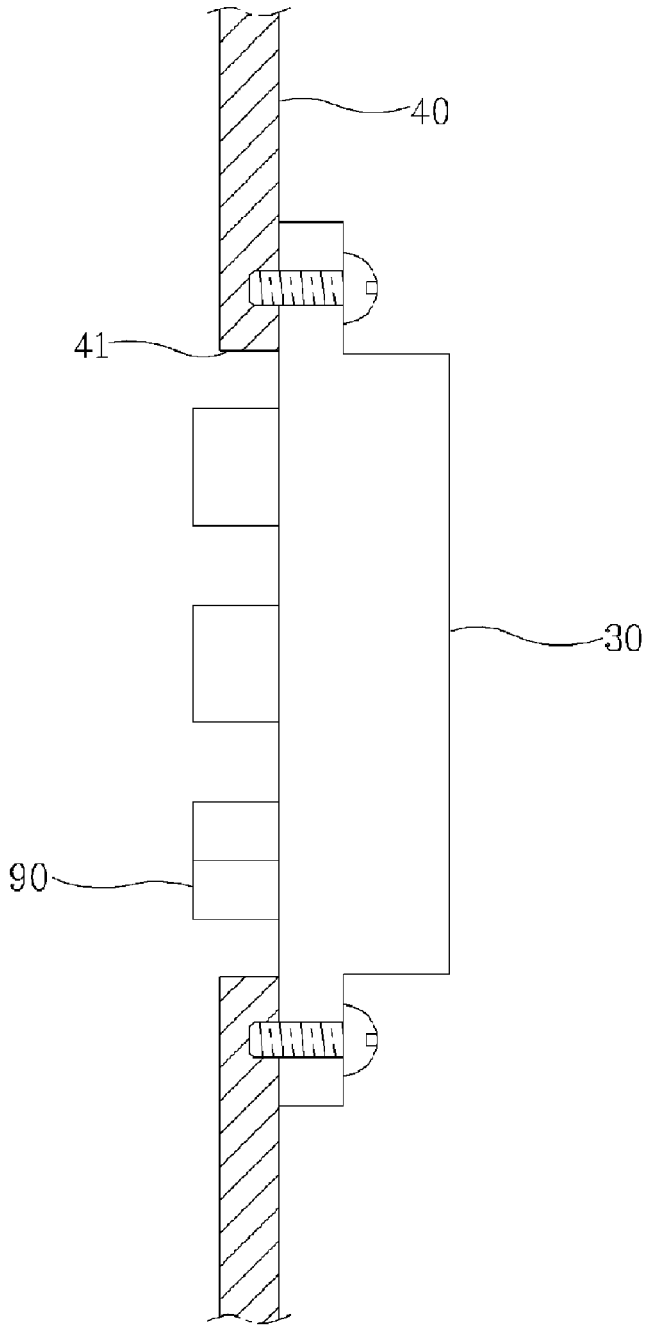
FIG. 6 Conventional Art
FIG. 6 is a sectional view illustrating a mounting state of the control device provided in the conventional refrigerator.

FIG. 3 is a flow chart illustrating a malfunction preventing method of a refrigerator according to the present invention.

The controlling part 66 identifies whether there is an input signal from the inputting part 60 that includes the static electricity switch 60*a* (S61). If there is an input signal, a step of S62 starts. If there is no input signal, the controlling part 66 waits an input signal.

The controlling part 66 determines whether the input signal is for a wait mode (S62). The wait mode starts if inputting is not performed by a user for a predetermined delay time period (t), which is in stead of an input mode. When the input mode starts, the control based on the user's inputting is performed immediately. If the present condition is the wait mode, a step of S63 starts. If the present mode is not the wait mode, a step of S67 starts.

The controlling part 66 ignores an input signal that is inputted first from the inputting part 60 (hereinafter, a first input signal) during the wait mode (S63). That is, the controlling part 66 does not perform the control based on the input signal.

In the step of S63, the controlling part 66 ignores the first input signal that might be produced by the electricity capacity variation because of moisture not by the user. As a result, malfunction of the refrigerator that might be caused by the first input signal may be prevented.

The controlling part 66 cancels the present wait mode performed based on the first input signal and it starts the input mode. The change into the input mode from the wait mode may be displayed through the displaying part 62. Specifically, the controlling part 66 may notify the user that the input mode starts by turning on/off the displaying part 62, letters, figures or icons (S64).

The controlling part 66 identifies whether there is an additional input signal from the inputting part 60 within a predetermined delay time period (t) (S65 and S66). If there is an input signal, a step of S67 starts. If there is no input signal, a step of S69 starts in that the wait mode re-starts.

The controlling part 66 performs control based on a second input signal that is received next to the first input signal or based on an input signal received next to the second signal in the input mode (hereinafter, an input signal that is received by the controlling part within a predetermined delay time period (t) after the first input signal is inputted is referenced to as "a second input signal") (S67).

That is, the controlling part 66 determines that the second input signal is an input signal directly inputted by the user and thus the driving part 64 and the displaying part 64 are controlled based on the second input signal.

Hence, the controlling part 66 identifies whether an additional input signal is inputted through the inputting part 60 within a predetermined delay time period (t) (S68). If there is an additional input signal, the step of S67 starts to perform control based on the input signal. If there is no additional input signal, a step of S69 starts.

The controlling part 66 changes the present input mode into the wait mode and the wait mode re-starts (S69).

Among the above steps, the step of S64 may be omitted in that the user is notified that the wait mode is canceled. Also, the steps of S65 and S66 will be united into one step 'the controlling part 66 identifies whether there is an additional input signal within a predetermined delay time period (t)'.

As mentioned above, the malfunction preventing device and a method thereof have following advantageous effects.

First, a malfunction of a refrigerator is prevented, because an input signal produced by electric capacity variation is removed.

Furthermore, the first input signal during the wait mode is ignored to prevent a malfunction of a refrigerator and the user is notified that the wait mode is canceled to perform the input mode.

A still further, according to the present invention, the controlling part may prevent a malfunction based on the predetermined algorism during the wait mode without any auxiliary devices.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A malfunction preventing device for a refrigerator, comprising: an inputting part in which a static electricity switch is provided to produce at least a first input signal and a second input signal for a plurality of user's commands, each input signal including control over a displaying part and a driving part of the refrigerator; and a controller, the controller having a wait mode, wherein the controller cancels the wait mode for a predetermined delay time period and ignores the first input signal related to the control over the displaying part and the driving part of the refrigerator when the first input signal is inputted when the controller is in the wait mode, wherein the controller processes the second input signal related to the control over the displaying part and the driving part of the refrigerator as soon as the controller receives the second input signal during the predetermined delay time period, and wherein the controller re-starts the wait mode if there is no input signal within the predetermined delay time period.

2. The malfunction preventing device for the refrigerator as claimed in claim 1, wherein the controller starts an input mode that is capable of receiving the second input signal related to the control over the displaying part and the driving part of the refrigerator after ignoring the first input signal inputted in the wait mode.

3. The malfunction preventing device for the refrigerator as claimed in claim 1, wherein the displaying part displays cancellation of the wait mode.

4. A method for preventing a malfunction of a refrigerator, comprising: providing an inputting part having a static electricity switch to produce at least a first input signal and a second input signal for a plurality of user's commands, the input signals having a control function over a displaying part and a driving part of the refrigerator; providing a controller that performs a wait mode; ignoring, via the controller, the first input signal related to the control function over the displaying part and the driving part of the refrigerator when the first input signal is inputted in the wait mode; canceling, via the controller, the wait mode for a predetermined delay time period after receiving the first input signal inputted in the wait mode; and starting, via the controller, an input mode that is capable of receiving the second input signal related to the control function over the displaying part and the driving part of the refrigerator after ignoring the first input signal inputted in the wait mode; and processing, via the controller, the second input signal related to the control function over the displaying part and the driving part of the refrigerator as soon as inputted within the predetermined delay time period after ignoring the first input signal inputted in the wait mode; and re-starting the wait mode if there is no input signal for the predetermined delay time period after starting the input mode.

5. The method for preventing a malfunction of the refrigerator as claimed in claim 4, further comprising: displaying cancellation of the wait mode after ignoring the first input signal.

* * * * *